United States Patent [19]

Ross

[11] 4,419,733

[45] Dec. 6, 1983

[54] TIME DEVIATION AND INADVERTENT INTERCHANGE CORRECTION FOR AUTOMATIC GENERATION CONTROL

[75] Inventor: Charles W. Ross, Lansdale, Pa.

[73] Assignee: Leeds & Northrup Company, North Wales, Pa.

[21] Appl. No.: 255,610

[22] Filed: Apr. 20, 1981

[51] Int. Cl.[3] ..... G06G 7/635

[52] U.S. Cl. ..... 364/493; 307/57

[58] Field of Search ..... 364/492, 493, 300; 307/57

[56] References Cited

U.S. PATENT DOCUMENTS

| | | | |
|---|---|---|---|
| 2,688,728 | 9/1954 | Carolus | 324/73 |
| 3,898,442 | 8/1975 | Cohn | 364/492 |
| 4,209,831 | 6/1980 | Ross | 364/492 |
| 4,267,571 | 5/1981 | Cohn | 364/493 |

OTHER PUBLICATIONS

Error Adaptive Control Computer for Interconnected Power Systems–Dr. C. W. Ross, Jan. 30–Feb. 4, 1966, pp. 745, 746.

*Primary Examiner*—Felix D. Gruber

*Attorney, Agent, or Firm*—William G. Miller, Jr.; Harold Huberfeld

[57] ABSTRACT

A method for modifying an area control error signal for controlling the generation in each area of a multiple-area interconnected electric power system using net-interchange tie-line bias control where the area control error is calculated in accordance with the equation $$ACE = \Delta P_{t1} - 10B \times \Delta f$$

where $\Delta P_{t1}$ is the deviation of the measured net interchange from its scheduled value, $\Delta f$ is the deviation of a system frequency from its set value, and B is the frequency bias of the area. The modification involves the integration of $\Delta P_{t1}$ to produce a signal representing a measured value of the inadvertent interchange $II'_{t1}$, and integration of $\Delta f$ to produce a signal representing the time deviation TD'. The time deviation is multiplied by the value $10Bf_o/3600$ times 1/T where B is the area frequency bias and 1/T is the control weighting factor. The product of the multiplication is subtracted from the signal $II'_{t1}$ and added to the area control error ACE to provide an error signal for correcting for inadvertent interchange and time deviation as well as for load changes. The integration of $\Delta P_{t1}$ and $\Delta f$ are periodically updated from accurate measurements of inadvertent interchange and time deviation.

4 Claims, 1 Drawing Figure

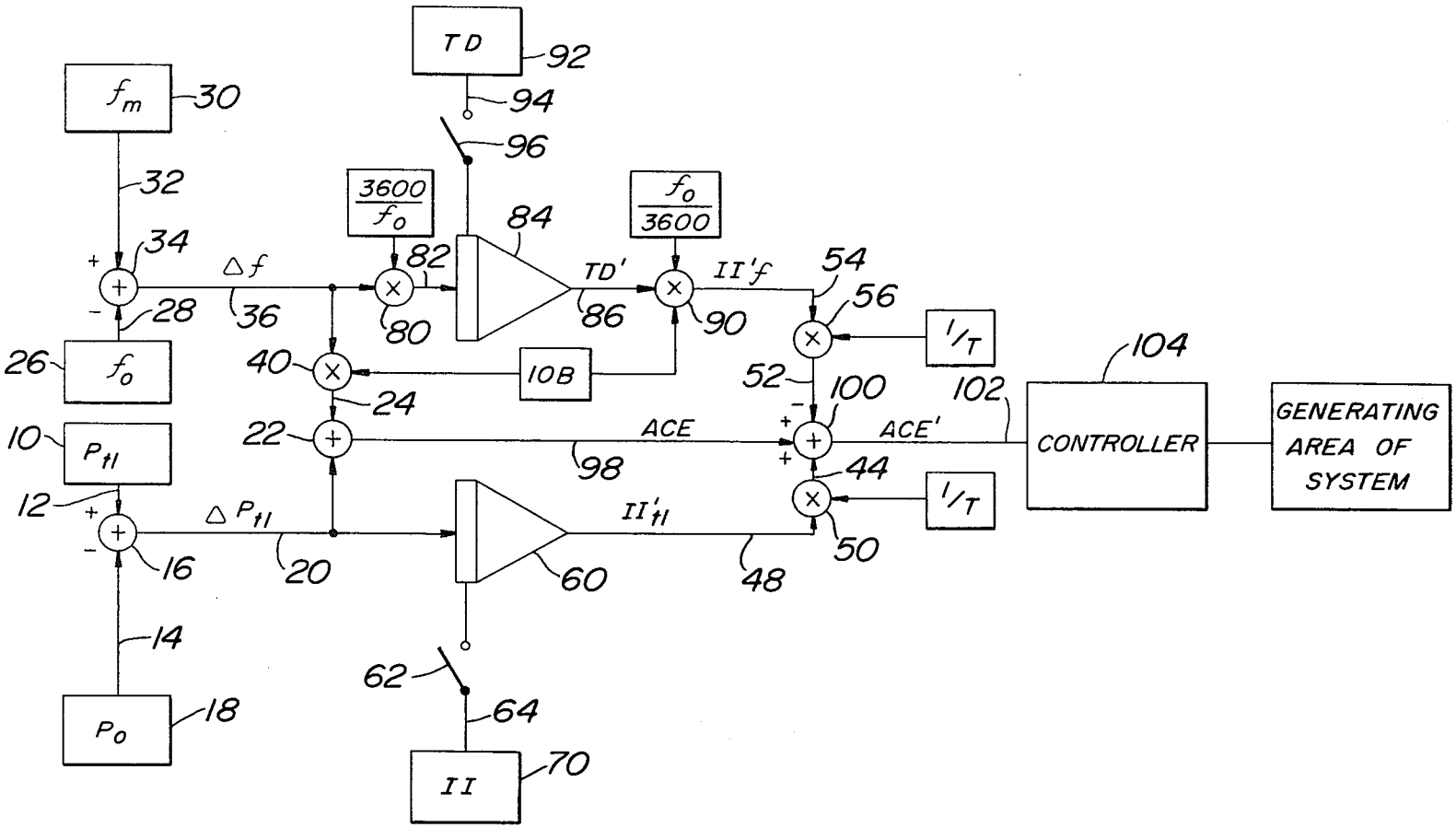
GENERATING AREA OF SYSTEM
CONTROLLER
104
102
1/T
1/T
ACE'
ACE
100
44
50
48
54
56
52
II'f
90
$\frac{f_o}{3600}$
TD'
86
10B
98
II'tl
60
92
TD
94
96
84
82
80
$\frac{3600}{f_o}$
24
40
22
20
62
64
70
II
36
Δf
ΔPtl
30
$f_m$
32
34
28
$f_o$
26
Ptl
10
12
16
14
18
Po

TIME DEVIATION AND INADVERTENT INTERCHANGE CORRECTION FOR AUTOMATIC GENERATION CONTROL

BACKGROUND OF THE INVENTION

The most common approach to the control of the generation within each load distribution control area of an interconnected electric power system is that known as net interchange tie-line bias control which operates to control the output of the generators in each area so as to tend to maintain the area control error signal at zero when for each control area the area control error signal is calculated in accordance with the following equation:

$$ACE=(P_{t1}-P_o)-10B(f_m-f_o) \quad (1)$$

thus, $$ACE=\Delta P_{t1}-10B(\Delta f) \quad (2)$$

where,

ACE = the area control error, a positive control error indicating a need for reducing generation.

$P_{t1}$ = the measured net interchange of the area in megawatts. Power flow "out" of an area is considered as positive.

$P_o$ = the scheduled net interchange of the area in megawatts, as preset.

B = the frequency bias setting for the area in megawatts per 0.1 Hz., considered to have a minus sign.

$f_m$ = measured system frequency in Hz.

$f_o$ = system frequency schedule in Hz., as preset.

The control signals which effect the change in generation of the generators in each area are usually derived from the area control error with appropriate consideration for a number of other measured and computed parameters as necessary to optimize economy and security of the area and the system of which it is a part while always tending to reduce the area control error to zero.

When control action in each area is such that the area control error is reduced to zero, if the control operates in a hypothetically perfect manner, the interconnected areas which makes up the power system, if they all control on the same basis, will collectively achieve operation at the scheduled frequency and the scheduled interchanges. This hypothetically perfect operation assumes that the algebraic sum of all area net-interchange schedules is equal to zero and the common scheduled frequency $f_o$ is the same for all areas. Perfect control in each area is, of course, never fully realized. Thus, there are deviations from the scheduled frequency and the scheduled net interchange in each area resulting from the natural droop of the governors, metering errors and the delay in response of the control system in each area as well as the imperfections in that response. Those deviations from the scheduled net interchange create undesired but unavoidable energy interchanges between the areas. Those interchanges are known as inadvertent interchange and are quantitatively the time integral of the deviation of the areas net interchange from its net-interchange schedule. Thus, the inadvertent interchange, II, may be calculated in accordance with the following equation:

$$II=\int(P_{t1}-P_o)dt \quad (3)$$

thus, $$II=\int\Delta P_{t1}dt \quad (4)$$

Inadvertent interchange includes two components. One is usually referred to as "intentional" inadvertent interchange. That component occurs when the area controls are effective and it results from the response of the governors on the areas generating capacity when the frequency is not at its scheduled value. Another component of the interchange is referred to as "unintentional". That component results from the failure of an area control system to reduce to zero the control error for the area.

Deviations from the scheduled frequency setting produce time deviations which must be corrected in order to maintain clocks reasonably close to correct time. The time deviation TD is quantitatively the time integral of the frequency deviation with an appropriate constant depending upon the magnitude of the scheduled frequency. Thus, time deviation in seconds accumulated in time t in hours may be calculated in accordance with the following equation:

$$TD=3600/f_o\int(f_m-f_o)dt \quad (5)$$

thus, $$TD=3600/f_o\int\Delta f dt \quad (6)$$

In controlling a large interconnection, it has become important to not only have each area maintain its scheduled net interchange and do its part in maintaining the scheduled frequency for the system, but also it is desirable to minimize the accumulated inadvertent interchange and time deviation.

Others have set forth methods for producing a modified area control error signal for the purpose of attempting to accomplish this task. One such system is disclosed in U.S. Pat. No. 3,898,442, issued Aug. 5, 1975, the disclosure of which is hereby incorporated by reference.

In the reference system, a modified area control error is obtained by adding two quantities or correction factors to the calculation of the normal area control error. A first one of those factors is obtained by periodically calculating from kilowatt-hour meter readings a quantity which is the total kilowatt-hour energy interchange, inadvertent interchange, between the area and the rest of the interconnected system for a predetermined period of time. That quantity is divided by a quantity representative of the period of time over which correction or payback of the energy interchange is desired. As suggested in the reference, the inadvertent interchange is calculated over a period of hours so that after each such period there is an updating of that quantity, identified in the reference as $I_a/H$.

The other factor which the reference adds in determination of the modified area control error is a time error correction which is broadcast from a central point in the system. This factor is proportional to the frequency bias setting B for the area times the time integral over a particular time period of the frequency deviation, all divided by the time period during which it is desired to make the correction, which time period is the same as that over which the inadvertent interchange correction occurs.

The method of incorporating these factors in the modified area control error is all shown in FIG. 3 of the reference. The system there disclosed has several disadvantages in that the factors such as $I_a/H$ are not erased as corrective action is taken by the control system. Thus, with the prior art system, it is necessary to wait for a period of an hour or so before the control system can see the correction which it has accomplished. Also, contributions to the additional factors, such as $I_a/H$, due to imperfect control must also wait the next updating of that quantity before the control system sees the corrective action required.

It is an object of this invention to provide a method of control and a means for carrying out that method with a modified area control error signal which will enable the control system of each area to minimize time deviation and inadvertent interchange in a manner which provides improved control in comparison with that available by systems known in the prior art.

It is a further object of this invention to provide for a control system including a modified area control error signal to provide control which makes up the deficiencies of the prior art systems as mentioned above so that the control continuously provides a corrective action tending to minimize inadvertent interchange and time deviation caused by imperfect control and measurement errors without having to wait for periodic updating of factors determinative of the corrective action required.

SUMMARY OF THE INVENTION

In accordance with this invention, there is provided a method and means for obtaining an improved control which uses an improved area control error signal for each area of a multiple-area interconnected electric power system using net-interchange tie-line bias control so that control from that error signal will not only tend to maintain the scheduled interchange over tie-lines interconnecting the area with the rest of the system, but will also provide for maintenance of the frequency at the scheduled value with correction of the inadvertent interchange and time deviation. This method obtains an area control error signal for effective control in the area in accordance with a calculation as set forth in the following equation:

$$ACE' = \Delta P_{t1} - 10B(\Delta f) + \frac{1}{T}\left[ II'_{t1} - \frac{10Bf_o(TD')}{3600} \right]; \quad (7)$$

where $$\Delta P_{t1} = P_{t1} - P_o \quad (8)$$

$$\Delta f = f_m - f_o \quad (9)$$

$$II'_{t1} = \int \Delta P_{t1} dt \quad (10)$$

$$TD' = 3600/f_o \int \Delta f dt, \quad (11)$$

and net interchange schedule setting, $P_o$,
net interchange measurement, $P_{t1}$,
scheduled system frequency setting, $f_o$,
system frequency measurement $= f_m$, and
the rate of energy payback, 1/T are signals provided for calculating the area control error signal. The calculation includes the steps of integrating the difference between the net-interchange measurement and its setting to produce a signal representing a measured value of the inadvertent interchange, $II'_{t1}$, and integrating the difference between the system frequency measurement and setting as required to produce a signal representing a measured value of time deviation, TD', in seconds. The improved area control error signal is then obtained by calculations in accordance with the above equation with periodic updating of the inadvertent interchange signal and the time deviation signal by correcting the integrations producing them from accurate measurements of those quantities.

BRIEF DESCRIPTION OF THE DRAWING

The single FIGURE is a block diagram of one circuit which can be used as an analog means for computing the modified area control error of this invention.

DESCRIPTION OF THE PREFERRED EMBODIMENT

The FIGURE provides an example of an analog circuit for calculating the modified area control error ACE' in accordance with equation (7). In the FIGURE, the scheduled tie-line interchange $P_{t1}$ is measured by summing up the power flows over the tie-lines interconnecting the area with the remainder of the interconnection. That summation is produced as, for example, by the instrument 10 which provides on line 12 a signal representative of $P_{t1}$. The signal representative of the set interchange, $P_o$, is produced by the setter 18 which is set in accordance with the desired net interchange between the area and the remainder of the system.

As a result of the comparison made by comparator 16, the signal $\Delta P_{t1}$ is produced on line 20 so that that signal appears as one input to the summer or comparator 22. The other input to the comparator 22 on line 24 is produced by first comparing the set frequency $f_o$ for the system with the measured frequency $f_m$. Thus, $f_o$, which is produced by setter 26 produces a signal on line 28 representing $f_o$ which the frequency measuring instrument 30 produces on line 32 a signal representing $f_m$. These signals are compared on comparator 34 and produce on line 36 the signal $\Delta f$. That signal is multiplied by the quantity 10B in multiplier 40 so that the signal on line 24 represents the quantity 10B$\times\Delta f$.

As shown in the FIGURE, the output of the comparator 22 is the usual area control error signal ACE which is normally used as a basis for controlling separate areas of interconnected power systems wherein the control is in accordance with a method known as net-interchange tie-line bias control, as mentioned previously. To modify that area control error with the two factors mentioned above for the minimization of inadvertent interchange and time deviation, it is necessary to add as a first of those factors a signal on line 44 representative of the inadvertent interchange $II'_{tl}$ which appears on line 48 after it has been modified in the multiplier 50 by a multiplication by a weighting factor 1/T. The other factor, which appears as a signal on line 52 is subtracted from the area control error ACE. That factor is produced from the quantity $II'_f$, the inadvertent interchange due to frequency deviation, on line 54. The factor $II'_f$ is multiplied in the multiplier 56 by a weighting factor 1/T, which weighting factor is preferably identical to that introduced in multiplier 50 and representative of the rate at which correction is to be made.

As shown in the FIGURE, the signal $II'_{tl}$ on line 48, representing the inadvertent interchange due to tie-line deviation, is produced from the signal on line 20 by the integrator 60 which, in the FIGURE, is an integrator which produces no sign change. As also shown in the FIGURE, the integrator is updated by the closing of switch 62 which connects the signal on line 64 to integrator 60 for the purposes of updating or initializing the integrator. After the initialization or update is completed, the switch is, of course, opened and the output of the integrator on line 48 will have the new updated value.

The inadvertent interchange represented by the signal on line 48 is initialized by the primed notation, $II'_{tl}$, as the calculated value of the interchange as compared with the signal from the instrument 70 which represents a more precise measurement of inadvertent interchange as noted by the unprimed notation, II. The signal produced by the instrument 70 may, for example, be obtained by summing the readings from the kilowatt-hour meters in the various interconnecting tie-lines by which the area is connected with the other areas of the system and subtracting from that the integral of the tie-line schedules for the same time period. Thus, the accurate readings of the energy interchanged with the rest of the connection are utilized to update the measurements obtained by integrating the interchange deviation $\Delta P_{tl}$.

In producing the signal on line 54 representative of $II'_f$ which may be considered as the inadvertent interchange resulting from a deviation of frequency from the standard value, it is necessary to first multiply the signal on line 36, representative of the frequency deviation $\Delta f$, by $3600/f_o$ as in multiplier 80. The resulting quantity is then introduced by way of the input line 82 to the integrator 84 so that the output of the integrator on line 86 produces a quantity representative of the measured time deviation, TD'. The quantity TD' is then multiplied by both a quantity 10B and a quantity $f_o/3600$ in the multiplier 90 to produce on the output of the multiplier 90, on line 54, the signal $II'_f$.

As is evident from the FIGURE, the integrator 84 is periodically updated from an accurate measurement of time deviation, TD, as provided by the instrument 92 on line 94 through the closing of the switch 96. By closing switch 96, the integrator 84 is initialized or updated so that the output on line 86 takes on a new value representative of the updated value, TD. After initialization, the switch 96 is opened and integration of the integrator 84 continues.

In the FIGURE, the area control error which appears on line 98 is modified by the two factors represented by the signals on lines 44 and 52 as by the addition of the signal on line 44 and the subtraction of the signal on line 52 in the summer 100 so as to produce on line 102 the modified area control error signal ACE'.

The modified area control error signal on line 102 can be used in control systems such as controller 104 of a type normally used for controlling the output of generators in power systems and may be used in any of the control systems which normally would use an area control error without those modifications. Such control systems would normally include a reset control action to produce what is essentially a double integral control and frequently also a proportional control action so that the generators in the area have their output increased or decreased so as to tend to reduce the area control error signal on line 102 towards zero.

While it is advisable that the weighting factors 1/T be the same as they are used to modify the inadvertent interchange signal $II'_{tl}$, as well as the signal $II'_f$, it is not necessary that these weighting factors be the same for all areas of the system for corrections may be made in the different areas at different rates. However, improved control can be obtained if the rates of correction by the several areas interconnected in the system are substantially the same.

With the arrangement of this invention, as shown in the FIGURE, corrections are continually made to minimize the inadvertent interchange and the time deviation as determined by the frequency and tie-line interchange measurements rather than allowing any changes that occur in the time deviation and the inadvertent interchange to remain uncorrected for as much as an hour or so as would be the case with the prior art system. Still this arrangement provides for the maintenance of the overall accuracy of the corrections by means of updating the integrations periodically in order to correct for the various errors such as meter errors, etc., which cause the integrations which produce $II'_{tl}$ and TD' to be less accurate than the measurements II and TD.

The system of the FIGURE will not require a continual transmission of the time deviation measurement to the area as is required in the prior art, for instead the frequency deviation measurement $\Delta f$ is integrated to produce a reasonably accurate time deviation, TD', which can then be periodically updated as previously mentioned, from the more accurate time deviation, TD. That accurate measurement may, for example, be a measurement provided by a particular entity in the system which is assigned the job of monitoring time deviation with the best obtainable accuracy.

It will be evident to those skilled in the art that the computation as performed in the system of the FIGURE may be carried out by any of a number of different analog systems arranged to carry out the necessary computations. It will also be evident that the computations may be performed by a digital computer.

What is claimed is:

1. A method of control for each area of a multiple-area interconnected electric power system for providing net-interchange tie-line bias control from an improved area control error signal provided so that said error signal is indicative of the sum of the load change in the area and the unscheduled energy transfer with the system as determined from signals available for each area representing the following measurements and settings: net interchange schedule setting, net interchange measurement, scheduled system frequency setting, system frequency measurement, an area frequency bias, and a control weighting factor, comprising:

producing a first difference signal by comparing the net interchange measurement and setting;

integrating said first difference signal to produce a signal representing a calculated value of the inadvertent interchange;

producing a second difference signal by comparing the system frequency measurement and setting;

integrating said second difference signal as required to produce a signal representing a calculated value of the time deviation;

modifying said time deviation signal to produce a signal representative of the inadvertent interchange due to frequency deviation;

producing an area control error signal by combining said first difference signal with said second difference signal modified by the area frequency bias;

modifying the area control error signal to produce the improved area control error signal by adding to said area control error signal said inadvertent interchange signal modified by said weighting factor and subtracting said inadvertent interchange due to frequency deviation as modified by said weighting factor;

periodically updating said inadvertent interchange signal and said time deviation signal in accordance with more accurate measurements of those factors; and modifying the generation in each area in response to the respective improved control error signals of the areas so as to reduce them toward zero to correct in each area for the inadvertent interchange and time deviation caused by the area.

2. The method as set forth in claim 1 in which the updating is carried out by periodically initializing each of said integrations to a value corresponding to said more accurate measurements.

3. Apparatus for controlling each area of a multiple-area interconnected electric power system for providing net-interchange tie-line bias control from an improved area control error signal provided so that said error signal is indicative of the sum of the load change in the area and the unscheduled energy transfer with the system as determined from signals available for each area representing the following measurements and settings: net interchange schedule setting, net interchange measurements, scheduled system frequency setting, system frequency measurement, an area frequency bias, and a control weighting factor, comprising:

means for producing a first different signal by comparing the net interchange measurement and setting;

means for integrating said first difference signal to produce a signal representing a calculated value of the inadvertent interchange;

means for producing a second difference signal by comparing the system frequency measurement and setting;

means for integrating said second difference signal as required to produce a signal representing a calculated value of the time deviation;

means for modifying said time deviation signal to produce a signal representative of the inadvertent interchange due to frequency deviation;

means for producing an area control error signal by combining said first difference signal with said second difference signal modified by the area frequency bias;

means for modifying the area control error signal to produce the improved area control error signal by adding to said area control error signal said inadvertent interchange signal modified by said weighting factor and subtracting said inadvertent interchange due to frequency deviation as modified by said weighting factor;

means for periodically updating said inadvertent interchange signal and said time deviation signal in accordance with more accurate measurements of those factors; and means for modifying the generation in each area in response to the respective improved control error signals of the areas so as to reduce them toward zero to correct in each area for the inadvertent interchange and time deviation caused by the area.

4. Apparatus as set forth in claim 3 in which the means for updating periodically initializes each of said integrating means to a value corresponding to said more accurate measurements.

* * * * *